US011169459B2

(12) United States Patent
Tanaka et al.

(10) Patent No.: US 11,169,459 B2
(45) Date of Patent: Nov. 9, 2021

(54) RESIN PARTICLE SET

(71) Applicant: FUJIFILM BUSINESS INNOVATION CORP., Tokyo (JP)

(72) Inventors: Tomoaki Tanaka, Kanagawa (JP); Tsuyoshi Murakami, Kanagawa (JP); Kana Yoshida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/926,845

(22) Filed: Jul. 13, 2020

(65) Prior Publication Data

US 2021/0255559 A1 Aug. 19, 2021

(30) Foreign Application Priority Data

Feb. 17, 2020 (JP) ..... JP2020-024708

(51) Int. Cl.

*G03G 9/08* (2006.01)
*G03G 9/09* (2006.01)
*G03G 9/087* (2006.01)

(52) U.S. Cl.

CPC ..... *G03G 9/0928* (2013.01); *G03G 9/0819* (2013.01); *G03G 9/0827* (2013.01); *G03G 9/08755* (2013.01); *G03G 9/092* (2013.01); *G03G 9/0906* (2013.01); *G03G 9/0926* (2013.01)

(58) Field of Classification Search

CPC .... G03G 9/0928; G03G 9/0906; G03G 9/092; G03G 9/0926

USPC ..... 430/107.1

See application file for complete search history.

(56) References Cited

U.S. PATENT DOCUMENTS

2010/0075241 A1* 3/2010 Kazmaier ..... G03G 9/0926 430/107.1

FOREIGN PATENT DOCUMENTS

JP 2017-003818 A 1/2017

* cited by examiner

*Primary Examiner* — Mark A Chapman
(74) *Attorney, Agent, or Firm* — Oliff PLC

(57) ABSTRACT

A resin particle set includes a fluorescent color resin particle containing a fluorescent coloring agent; and a colored resin particle containing a colored coloring agent, wherein a volume average particle diameter of the fluorescent color resin particles is larger than a volume average particle diameter of the colored resin particles, and an average circularity of the fluorescent color resin particles is 0.93 or more.

12 Claims, 3 Drawing Sheets

RESIN PARTICLE SET

CROSS-REFERENCE TO RELATED APPLICATIONS

This application is based on and claims priority under 35 USC 119 from Japanese Patent Application No. 2020-024708 filed on Feb. 17, 2020.

BACKGROUND

(i) Technical Field

The present disclosure relates to a resin particle set.

(ii) Related Art

Resin particles have various applications, one of which is a toner for electrophotography. As a toner in the related art, one disclosed in JP-A-2017-3818 is known.

JP-A-2017-3818 discloses a toner containing a binder resin and a coloring agent, in which the coloring agent contains a coloring pigment and a fluorescent dye, and when the contents of the coloring pigment and the fluorescent dye based on weight in the toner are respectively set as $W_G$ and $W_F$, the $W_G$ and the $W_F$ satisfy the expression (1): $W_G \times 0.5 > W_F > W_G \times 0.025$, and when an absorption peak wavelength of the coloring pigment is set as $P_G$ and an emission peak wavelength of the fluorescent dye is set as $P_F$, the $P_G$ and the $P_F$ satisfy the expression (2): $P_G < P_F$.

SUMMARY

Aspects of non-limiting embodiments of the present disclosure relate to a resin particle set including a fluorescent color resin particle containing a fluorescent coloring agent and a colored resin particle containing a colored coloring agent, which is excellent in color reproducibility of an image to be obtained, as compared with a case where a volume average particle diameter of the fluorescent color resin particles is equal to or smaller than a volume average particle diameter of the colored resin particles, or an average circularity of the fluorescent color resin particles is less than 0.93.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address the advantages described above.

According to an aspect of the present disclosure, there is provided a resin particle set including:

a fluorescent color resin particle containing a fluorescent coloring agent; and a colored resin particle containing a colored coloring agent, wherein a volume average particle diameter of the fluorescent color resin particles is larger than a volume average particle diameter of the colored resin particles, and an average circularity of the fluorescent color resin particles is 0.93 or more.

BRIEF DESCRIPTION OF THE DRAWINGS

Exemplary embodiments of the present disclosure will be described in detail based on the following figures, wherein.

DETAILED DESCRIPTION

Figure 1:
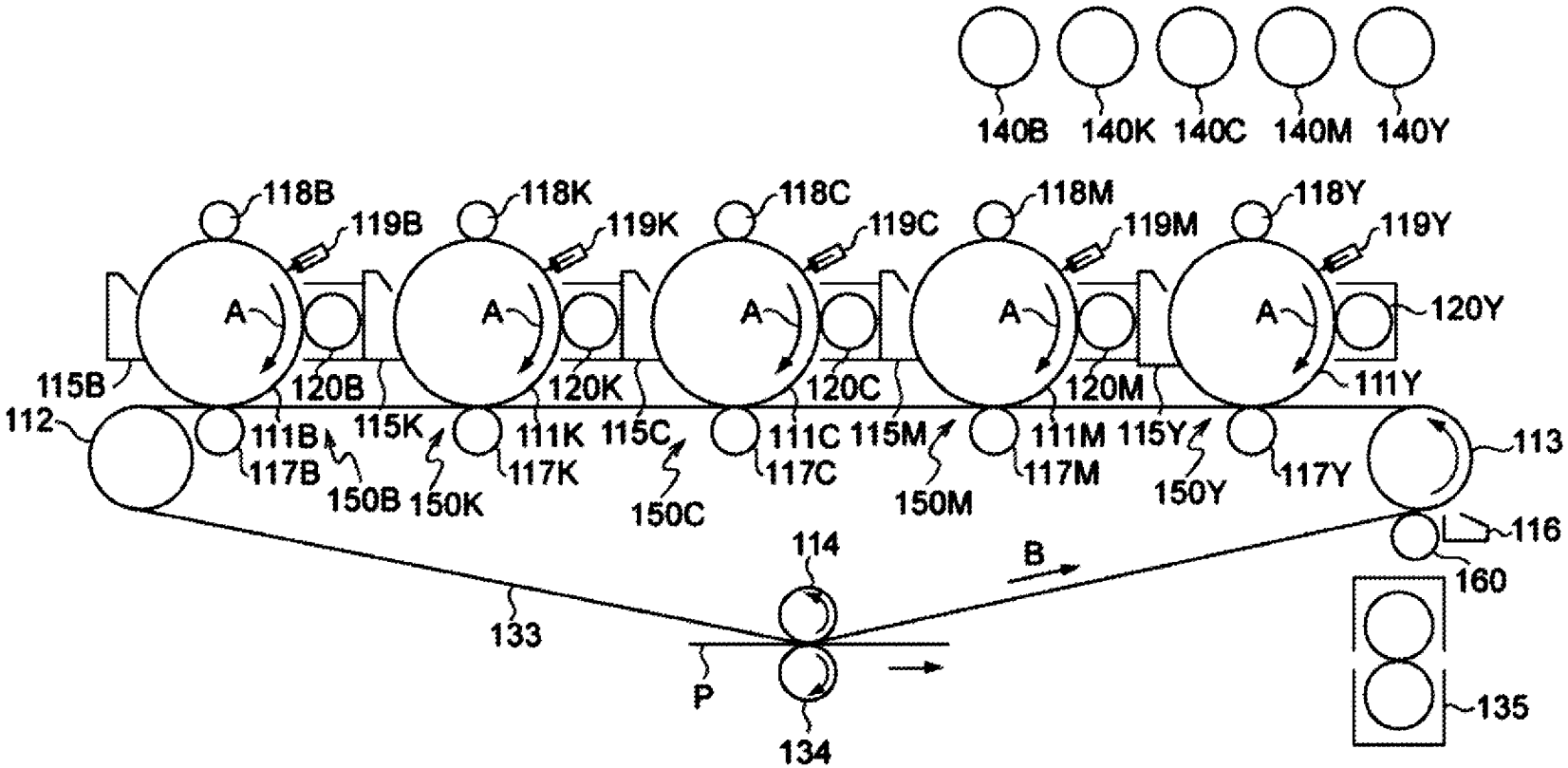
FIG. 1 is a configuration diagram illustrating an example of an image forming apparatus used in the exemplary embodiment.

In a case where the amount of each component in the composition is referred to in the present specification, when there are plural substances corresponding to each component in the composition, unless otherwise specified, it means the total amount of the plural substances present in the composition.

In this specification, "electrostatic charge image developing toner" is also simply referred to as "toner", and "electrostatic charge image developer" is also simply referred to as "developer".

Hereinafter, the exemplary embodiment which is an example of the present disclosure will be described.

<Resin Particle Set>

A resin particle set includes a fluorescent color resin particle containing a fluorescent coloring agent; and a colored resin particle containing a colored coloring agent, in which a volume average particle diameter of the fluorescent color resin particles is larger than a volume average particle diameter of the colored resin particles, and an average circularity of the fluorescent color resin particles is 0.93 or more.

The fluorescent color resin particle contains a fluorescent coloring agent, and when electrons excited by absorbing the irradiation energy in a short wavelength region of visible light from the ultraviolet light contained in incident light, return to a ground state, energy is emitted, and thus the resin particle satisfies spectral reflectance>1 in a specific wavelength region. A short-wavelength component from ultraviolet to the visible light has the property of being easily reflected and diffused, and has the property that the color reproducibility is likely to change due to color mixing or deletion. In addition, since fluorescent color looks clear as compared with non-fluorescent color, the difference may be emphasized with respect to the deterioration of the color reproducibility due to the disturbance of the arrangement of resin particles in the superposition of unfixed images and multiply transferring, and the color turbidity due to scattering.

By making the volume average particle diameter of the fluorescent color resin particles larger than the volume average particle diameter of the colored resin particles, color mixture due to the disturbance of the arrangement and scattering of the resin particles in superposition of unfixed images and multiply transferring is prevented. Further, by setting the average circularity of the fluorescent color resin particles to be 0.93 or more, the disturbance of the arrangement and scattering of the fluorescent color resin particles are prevented, and further, the color developability becomes excellent, so that an image to be the obtained is excellent in the color reproducibility.

Hereinafter, the resin particle set according to the exemplary embodiment will be described in detail.

—Relationship Between Volume Average Particle Diameter of Fluorescent Color Resin Particles and Volume Average Particle Diameter of Colored Resin Particles—

In the resin particle set according to the exemplary embodiment, the volume average particle diameter of the fluorescent color resin particles is larger than the volume average particle diameter of the colored resin particles, and from the viewpoint of the color reproducibility, image quality, and fluorescence intensity, a value of (volume average particle diameter of the fluorescent color resin particles)−(volume average particle diameter of the colored resin particles) is preferably 0.1 μm or more, more preferably 0.3 μm or more, still more preferably 0.5 μm or more, and particularly preferably 0.7 μm or more.

In addition, from the viewpoint of the color reproducibility, the image quality, and the fluorescence intensity, an upper limit of the value of (volume average particle diameter of the fluorescent color resin particles)−(volume average particle diameter of the colored resin particles) is preferably 5.0 μm or less, more preferably 3.0 μm or less, still more preferably 2.5 μm or less, and particularly preferably 2.0 μm or less.

The volume average particle diameter ($D_{50v}$) of the fluorescent color resin particles is preferably more than 2 μm and 10 μm or less, more preferably from 3 μm to 8 μm, and still more preferably from 4 μm to 7 μm, and particularly preferably from 5.0 μm to 6.5 μm, from the viewpoint of the color reproducibility, the image quality, and the fluorescence intensity.

The volume average particle diameter ($D_{50v}$) of the colored resin particles is preferably 2 μm or more and less than 10 μm, more preferably from 3 μm to 8 μm, and still more preferably from 3.5 μm to 7 μm or less, and particularly preferably from 4.0 μm to 6.0 μm, and most preferably 4.0 μm or more to less than 5.0 μm, from the viewpoint of color reproducibility, the image quality, and the fluorescence intensity.

The volume average particle diameter of the fluorescent color resin particle and the volume average particle diameter of the colored resin particles are measured by using Coulter Multisizer II (manufactured by Beckman Coulter, Inc.), with ISOTON-II (manufactured by Beckman Coulter, Inc.) being used as an electrolytic solution.

In the measurement, a measurement sample having a content from 0.5 mg to 50 mg is added to 2 mL of an aqueous solution containing a surfactant (preferably sodium alkyl benzene sulfonate) as a dispersing agent in an amount of 5% by weight. The obtained material is added to from 100 mL to 150 mL of the electrolytic solution.

The electrolytic solution in which the sample is suspended is subjected to a dispersion treatment using an ultrasonic disperser for one minute, and a particle diameter of each of the particles having a particle diameter falling within the range of 2 μm to 60 μm is measured by a Coulter Multisizer II using an aperture having an aperture diameter of 100 μm. 50,000 particles are sampled.

Regarding the measured particle diameters, a volume-based cumulative distribution is drawn from the small diameter side, and the particle diameter which reaches the cumulative 50% is defined as a volume average particle diameter $D_{50v}$.

—Average Circularity of Fluorescent Color Resin Particles and Average Circularity of Colored Resin Particles—

In the resin particle set according to the exemplary embodiment, the average circularity of the fluorescent color resin particles is 0.93 or more, preferably from 0.93 to 0.98, and more preferably from 0.940 to 0.975, and particularly preferably from 0.950 to 0.970 from the viewpoint of the color reproducibility, the image quality, and the fluorescence intensity.

In addition, the average circularity of the colored resin particles is not particularly limited, and is preferably 0.93 or more, more preferably from 0.93 to 0.98, still more preferably from 0.940 to 0.975, and particularly preferably from 0.950 to 0.970, from the viewpoint of the color reproducibility, the image quality, and the fluorescence intensity.

In the exemplary embodiment, the circularity of the resin particle is one determined by (perimeter of circle having the same area as the particle projection image)/(perimeter of particle projection image), and the average circularity of the resin particles is the circularity of the particle that reaches 50% of the total number of the particles cumulated from the smaller side in the circularity distribution. The average circularity of the resin particles is obtained by analyzing at least 3,000 resin particles with a flow type particle image analyzer.

The average circularity of the resin particles may be controlled by adjusting a stirring speed of a dispersion, a temperature of the dispersion, or a keeping time in a coalescence step, for example, in a case where the resin particles are produced by an aggregation and coalescence method.

—Volume Proportion of Resin Particle Having Particle Diameter of 4 μm or Less Contained in Fluorescent Color Resin Particle—

In the resin particle set according to the exemplary embodiment, the volume proportion of the resin particles having a particle diameter of 4 μm or less contained in the fluorescent color resin particles is preferably 6% or less, more preferably 5% or less, still more preferably 4% or less, and particularly preferably 3.5% or less from the viewpoint of the color reproducibility, the image quality, and the fluorescence intensity.

A method of measuring the volume proportion of the resin particle having a particle diameter of 4 μm or less contained in the fluorescent color resin particle is performed by measuring the volume-based particle diameter distribution by the same method as that of the volume average particle diameter of the fluorescent color resin particles, and then calculating the volume proportion of the resin particle having a particle diameter of 4 μm or less.

Hereinafter, in a case where the term "resin particle" is used without referring to the fluorescent color resin particle or the colored resin particle, both the fluorescent color resin particles and the colored resin particles will be described.

The resin particle set according to the exemplary embodiment may have two or more kinds of the fluorescent color resin particles, or may have two or more kinds of the colored resin particles.

Examples of the colored resin particles include a yellow resin particle, a magenta resin particle, a cyan resin particle, a black resin particle, a red resin particle, a green resin particle, a blue resin particle, an orange resin particle, and a violet resin particle.

Among them, from the viewpoint of easily forming a full-color image, the resin particle set according to the exemplary embodiment preferably has a yellow resin particle, a magenta resin particle, and a cyan resin particle as the colored resin particle, and more preferably has a yellow resin particle, a magenta resin particle, a cyan resin particle, and a black resin particle as the colored resin particle.

The fluorescent color resin particle contains a binder resin, a fluorescent coloring agent, and, as needed, a release agent and other additives, and preferably contains a binder resin, a fluorescent coloring agent, and a release agent.

The colored resin particle contains a binder resin, a colored coloring agent, and, as needed, a release agent and other additives, and preferably contains a binder resin, a colored coloring agent, and a release agent.

—Fluorescent Coloring Agent—

The fluorescent color resin particle contains a fluorescent coloring agent.

In addition, the colored resin particle preferably does not contain a fluorescent coloring agent.

The fluorescent coloring agent may be any coloring agent that exhibits fluorescence, and is preferably a coloring agent that exhibits fluorescence in the visible light region (wavelength from 380 nm to 760 nm). The light that excites the fluorescent coloring agent is not particularly limited, and preferably includes at least visible light or ultraviolet light, and more preferably includes at least ultraviolet light.

Further, the fluorescent coloring agent may be a fluorescent pigment or a fluorescent dye, and is preferably a fluorescent dye.

Note that, in the exemplary embodiment, the "pigment" is a coloring agent in which each of a solubility in 100 g of water at 23° C. and a solubility in 100 g of cyclohexanone at 23° C. is less than 0.1 g, and the "dye" is a coloring agent in which a solubility in 100 g of water at 23° C. or a solubility in 100 g of cyclohexanone at 23° C. is 0.1 g or more.

Further, the color of the fluorescent coloring agent is not particularly limited and may be appropriately selected as desired.

Examples of the fluorescent coloring agent include a fluorescent pink coloring agent, a fluorescent red coloring agent, a fluorescent orange coloring agent, a fluorescent yellow coloring agent, a fluorescent green coloring agent, and a fluorescent purple coloring agent.

Among them, the fluorescent pink coloring agent, the fluorescent red coloring agent, the fluorescent orange coloring agent, the fluorescent yellow coloring agent, or the fluorescent green coloring agent is preferable, the fluorescent pink coloring agent, the fluorescent yellow coloring agent, or the fluorescent green coloring agent is more preferable, and the fluorescent pink coloring agent is particularly preferable.

In addition, the fluorescent color resin particle is preferably a fluorescent pink resin particle, a fluorescent red resin particle, a fluorescent orange resin particle, a fluorescent yellow resin particle, a fluorescent green resin particle, a fluorescent purple resin particle, a fluorescent vermilion resin particle, or a fluorescent light blue resin particle, more preferably the fluorescent pink resin particle, the fluorescent yellow resin particle, or the fluorescent green resin particle, and particularly preferably the fluorescent pink resin particle.

A fluorescent peak wavelength in the spectral reflectance of the fluorescent coloring agent may be appropriately selected according to the desired color. For example, in a case where it is desired to express fluorescence pink as a color, it is preferably from 560 nm to 670 nm, and more preferably from 580 nm to 650 nm.

Figure 3:
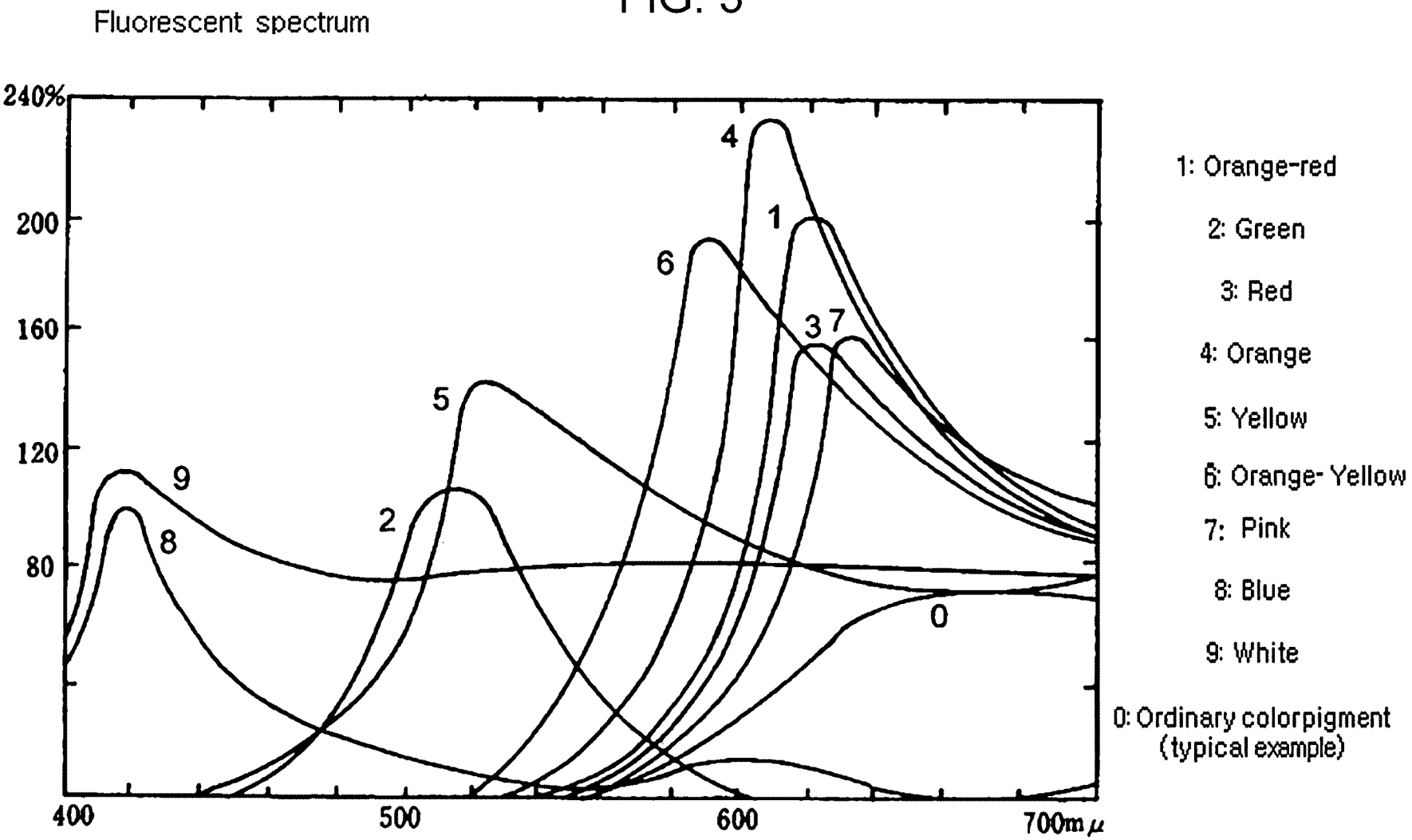
FIG. 3 is a graph showing the spectrum of each fluorescent color.

An example of the spectrum of each fluorescent color is shown in FIG. 3 and will be described below. In FIG. 3, a vertical axis represents fluorescence intensity and a horizontal axis represents wavelength. Note that "mμ"="nm".

In addition, the value of the spectral reflectance of the fluorescent coloring agent at the fluorescence peak wavelength is preferably 100% or more, more preferably 105% or more, and particularly preferably 110% or more from the viewpoint of image graininess.

As the fluorescent coloring agent, a known fluorescent coloring agent may be used. Specific examples thereof include Basic Red 1 (Rhodamine 6G), Basic Red 1:1, Basic Red 2, Basic Red 12, Basic Red 13, Basic Red 14, Basic Red 15, Basic Red 36, Basic Violet 7, Basic Violet 10 (Rhodamine B), Basic Violet 11 (Rhodamine 3B), Basic Violet 11:1 (Rhodamine A), Basic Violet 15, Basic Violet 16, Basic Violet 27, Pigment Yellow 101, Basic Yellow 1, Basic Yellow 2, Basic Yellow 9, Basic Yellow 24, Basic Yellow 40, Basic Orange 15, Basic Orange 22, Basic Blue 1, Basic Blue 3, Basic Blue 7, Basic Blue 9, Basic Blue 45, Basic Green 1, Acid Yellow 3, Acid Yellow 7, Acid Yellow 73, Acid Yellow 87, Acid Yellow 184, Acid Yellow 245, Acid Yellow 250, Acid Red 51, Acid Red 52, Acid Red 57, Acid Red 77, Acid Red 87, Acid Red 89, Acid Red 92, Acid Blue 9, Acid Black 2, Solvent Yellow 43, Solvent Yellow 44, Solvent Yellow 85, Solvent Yellow 98, Solvent Yellow 116, Solvent Yellow 131, Solvent Yellow 145, Solvent Yellow 160:1, Solvent Yellow 172, Solvent Yellow 185, Solvent Yellow 195, Solvent Yellow 196, Solvent Orange 63, Solvent Orange 112, Solvent Red 49, Solvent Red 149, Solvent Red 175, Solvent Red 196, Solvent Red 197, Solvent Blue 5, Solvent Green 5, Solvent Green 7, Direct Yellow 27, Direct Yellow 85, Direct Yellow 96, Direct Orange 8, Direct Red 2, Direct Red 9, Direct Blue 22, Direct Blue 199, Direct Green 6, Disperse Yellow 11, Disperse Yellow 82, Disperse Yellow 139, Disperse Yellow 184, Disperse Yellow 186, Disperse Yellow 199, Disperse Yellow 202, Disperse Yellow 232, Disperse Orange 11, Disperse Orange 32, Disperse Red 58, Disperse Red 274, Disperse Red 277, Disperse Red 303, Disperse Blue 7, Reactive Yellow 78, and Vat Red 41.

One or more of these are selected according to the desired color. For example, in a case of expressing the fluorescent pink, at least one fluorescent coloring agent selected from the group consisting of Basic Red 1 (Rhodamine 6G), Basic Red 1:1, Basic Red 2, Basic Red 12, Basic Red 13, Basic Red 14, Basic Red 15, Basic Red 36, Basic Violet 7, Basic Violet 10 (Rhodamine B), Basic Violet 11 (Rhodamine 3B), Basic Violet 11:1 (Rhodamine A), Basic Violet 15, Basic Violet 16, and Basic Violet 27 is preferable.

The fluorescent coloring agent preferably contains a fluorescent coloring agent having a xanthene structure, a naphthalene structure, or a triarylmethane structure, and more preferably contains a fluorescent coloring agent having a xanthene structure, from the viewpoint of fluorescence intensity and image graininess.

Further, the xanthene structure is preferably a rhodamine structure, a fluorescein structure, or an eosin structure, and more preferably a rhodamine structure.

The fluorescent color resin particle may include one kind of fluorescent coloring agent alone, or may include two or more kinds thereof in combination.

The content of the fluorescent coloring agent is preferably from 0.2% by weight to 5% by weight, more preferably from 0.2% by weight to 3% by weight, and particularly preferably from 0.2% by weight to 2% by weight, with respect to the entire resin particles from the viewpoint of the fluorescence intensity and the image graininess.

—Colored Coloring Agent—

The colored resin particle includes a colored coloring agent.

Further, the fluorescent color resin particle preferably contains a fluorescent coloring agent and a colored coloring agent from the viewpoint of the color reproducibility.

The colored coloring agent in the exemplary embodiment is one that absorbs any light in the visible light region (wavelength of from 380 nm to 760 nm).

A known coloring agent is used as the colored coloring agent.

Further, the colored coloring agent is preferably a coloring agent that does not show fluorescence in the visible light region.

Further, the colored coloring agent may be a pigment or a dye, and is preferably a pigment.

Specific examples of the colored coloring agent include magenta pigments such as C.I. Pigment Red 1, the same 2, the same 3, the same 4, the same 5, the same 6, the same 7, the same 8, the same 9, the same 10, the same 11, the same 12, the same 14, the same 15, the same 16, the same 17, the same 18, the same 21, the same 22, the same 23, the same 31, the same 32, the same 38, the same 41, the same 48, the same 48:1, the same 48:2, the same 48:3, the same 48:4, the same 49, the same 52, the same 53:1, the same 54, the same 57:1, the same 58, the same 60:1, the same 63, the same 64:1, the same 68, the same 81:1, the same 81:4, the same 83, the same 88, the same 89, the same 112, the same 114, the same 122, the same 123, the same 144, the same 146, the same 149, the same 150, the same 166, the same 170, the same 176, the same 177, the same 178, the same 179, the same 184, the same 185, the same 187, the same 202, the same 206, the same 207, the same 208, the same 209, the same 210, the same 220, the same 221, the same 238, the same 242, the same 245, the same 253, the same 254, the same 255, the same 256, the same 258, the same 264, the same 266, the same 269, and the same 282, and Pigment Violet 19; magenta dyes such as C.I. Solvent Red 1, the same 3, the same 8, the same 23, the same 24, the same 25, the same 27, the same 30, the same 49, the same 52, the same 58, the same 63, the same 81, the same 82, the same 83, the same 84, the same 100, the same 109, the same 111, the same 121, and the same 122: C.I. Disperse Red 9; C.I. Basic Red 1, the same 2, the same 9, the same 12, the same 13, the same 14, the same 15, the same 17, the same 18, the same 22, the same 23, the same 24, the same 27, the same 29, the same 32, the same 34, the same 35, the same 36, the same 37, the same 38, the same 39, and the same 40; and various pigments such as red oxide, cadmium red, red lead, mercury sulfide, Permanent Red 4R, Resol Red, Pyrazolone Red, Watching red, calcium salt, Lake Red D, Brilliant Carmine 6B, Eosin Lake, Rotamine Lake B, Alizarin Lake, Brilliant Carmine 3B, Carbon black, Chrome Yellow, Hansa Yellow, Benzidine Yellow, Slen Yellow, Quinoline Yellow, Pigment Yellow, Permanent Orange GTR, Pyrazolone Orange, Balkan Orange, Brilliant Carmine 3B, Brilliant Carmine 6B, DuPont Oil Red, Lake Red C, Aniline Blue, Ultramarine Blue, Calco oil blue, Methylene Blue Chloride, Phthalocyanine Blue, Pigment Blue, Phthalocyanine Green, Malachite Green Oxalate, or various dyes. In addition, solid solution pigments (those in which two or more kinds of pigments are solid-solved to change the crystal structure) are also preferable, and specifically, combinations of quinacridone having different substituents (unsubstituted quinacridone PV19 and PR122, PV19 and PR202, or the like) may be exemplified as an example.

Other coloring agents are appropriately selected according to the desired color. For example, in a case where it is desired to express fluorescent pink, inclusion of a magenta pigment may be exemplified as an example. Among them, the solid solution pigments are preferable. As a fluorescent color, the performance is good if a bright color or a dark color may be produced even with the same color tone, but the performance tends to be improved by using the solid solution pigment.

The colored coloring agent may be used alone or two or more kinds thereof may be used in combination.

As the colored coloring agent, a surface-treated coloring agent may be used as needed, and the colored coloring agent may be used together with a dispersing agent. Further, plural kinds of the coloring agents may be used in combination.

From the viewpoint of color reproducibility, the content of the colored coloring agent in the colored resin particles is preferably from 0.1% by weight to 30% by weight, more preferably from 0.2% by weight to 20% by weight, and particularly preferably from 0.5% by weight to 10% by weight with respect to the entire colored resin particles.

From the viewpoint of the fluorescence intensity and the color reproducibility, the content of the colored coloring agent in the fluorescent color resin particles is preferably from 0.1% by weight to 30% by weight, more preferably from 0.2% by weight to 15% by weight, and particularly preferably from 0.5% by weight to 5% by weight with respect to the entire fluorescent color resin particles.

—Binder Resin—

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer in the coexistence of such a non-vinyl resin.

Among them, a styrene-acrylic copolymer or a polyester resin is preferably used, and a polyester resin is more preferably used.

These binder resins may be used singly or in combination of two or more types thereof.

Examples of the binder resin include an amorphous (also referred to as "non-crystalline") resin and a crystalline resin.

The binder resin preferably contains a crystalline resin, more preferably contains an amorphous resin, and still more preferably contains a crystalline resin, from the viewpoint of preventing density unevenness in an image to be obtained.

The content of the crystalline resin is preferably from 2% by weight to 40% by weight, and more preferably from 2% by weight to 20% by weight with respect to the total weight of the binder resin.

In addition, "crystallinity" of resin means to have a clear endothermic peak instead of a stepwise endothermic energy amount change in differential scanning calorimetry (DSC), and specifically means that the half-width of the endothermic peak at the time of being measured at the rate of temperature increase of 10 (° C./min) is within 10° C.

On the other hand, "amorphous" of the resin means that the half-width exceeds 10° C., a stepwise endothermic energy amount change is exhibited, or that no clear endothermic peak is observed.

<<Polyester Resin>>

Examples of the polyester resin include a well-known polyester resin.

Amorphous Polyester Resin

Examples of the amorphous polyester resin include condensation polymers of a polyvalent carboxylic acid and a polyhydric alcohol. The amorphous polyester resin may be a commercially available product or those obtained by performing synthesization.

Examples of the polyvalent carboxylic acid include an aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, an aromatic dicarboxylic acid is preferably used as the polyvalent carboxylic acid.

As the polyvalent carboxylic acid, tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, an aromatic diol and an alicyclic diol are preferably used, and an aromatic diol is further preferably used as the polyhydric alcohol.

As the polyhydric alcohol, a tri- or higher-valent polyhydric alcohol employing a crosslinked structure or a branched structure may be used in combination with a diol. Examples of the tri- or higher-valent polyhydric alcohol include glycerin, trimethylolpropane, and pentaerythritol.

The polyhydric alcohol may be used singly or in combination of two or more types thereof.

The glass-transition temperature (Tg) of the amorphous polyester resin is preferably from 50° C. to 80° C., and further preferably from 50° C. to 65° C.

The glass-transition temperature is obtained from a DSC curve obtained by differential scanning calorimetry (DSC). More specifically, the glass-transition temperature is obtained from "extrapolated glass transition onset temperature" described in the method of obtaining a glass-transition temperature in JIS K 7121-1987 "testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using GPC & HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated from the results of the foregoing measurement by using a molecular weight calibration curve plotted from a monodisperse polystyrene standard sample.

A known production method is used to produce the amorphous polyester resin. Specific examples thereof include a method of conducting a reaction at a polymerization temperature set to be from 180° C. to 230° C., as needed, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include a condensation polymer of polyvalent carboxylic acid and polyhydric alcohol. The crystalline polyester resin may be a commercially available product or those obtained by performing synthesization.

Here, in order to easily form a crystalline structure, the crystalline polyester resin is preferably a polycondensate using a polymerizable monomer having a linear aliphatic group rather than a polymerizable monomer having an aromatic group.

Examples of the polyvalent carboxylic acid include aliphatic dicarboxylic acid (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acid (such as phthalic acid, isophthalic acid, terephthalic acid, dibasic acids such as naphthalene-2, and 6-dicarboxylic acid), and these anhydrides or lower (such as 1 to 5 carbon atoms) alkyl esters thereof.

As the polyvalent carboxylic acid, a tri- or higher-valent carboxylic acid employing a crosslinked structure or a branched structure may be used in combination with a dicarboxylic acid. Examples of the trivalent carboxylic acid include an aromatic carboxylic acid (such as 1,2,3-benzenetricarboxylic acid, 1,2,4-benzenetricarboxylic acid, and 1,2,4-naphthalenetricarboxylic acid), and these anhydrides or lower (for example, 1 to 5 carbon atoms) alkyl esters thereof.

As the polyvalent carboxylic acid, a dicarboxylic acid having a sulfonic acid group and a dicarboxylic acid having an ethylenic double bond may be used in combination with these dicarboxylic acids.

The polyvalent carboxylic acid may be used singly or in combination of two or more types thereof.

Examples of the polyhydric alcohol include aliphatic diols (for example, straight-chain aliphatic diols having 7 to 20 or less carbon atoms in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosan decanediol. Among these, 1,8-octanediol, 1,9-nonanediol, and 1,10-decanediol are preferable as the aliphatic diol.

As the polyhydric alcohol, a tri- or higher-valent alcohol employing a crosslinked structure or a branched structure may be used in combination with diol. Examples of the tri- or higher-valent alcohols include glycerin, trimethylolethane, trimethylolpropane, and pentaerythritol.

The polyhydric alcohol may be used singly or in combination of two or more types thereof.

Here, the polyhydric alcohol preferably has an aliphatic diol content of 80% by mol or more, and is preferably 90% by mol or more.

The melting temperature of the crystalline polyester resin is preferably from 50° C. to 100° C., more preferably from 55° C. to 90° C., and still more preferably from 60° C. to 85° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The weight average molecular weight (Mw) of the crystalline polyester resin is preferably from 6,000 to 35,000.

Similar to the amorphous polyester, the crystalline polyester resin may be obtained by a known production method.

The weight average molecular weight (Mw) of the binder resin is preferably from 5,000 to 1,000,000, more preferably from 7,000 to 500,000, and particularly preferably from 25,000 to 60,000 from the viewpoint of rubbing resistance of the image. The number average molecular weight (Mn) of the binder resin is preferably from 2,000 to 100,000. The molecular weight distribution Mw/Mn of the binder resin is preferably from 1.5 to 100, and more preferably from 2 to 60.

The weight average molecular weight and the number average molecular weight of the binder resin are measured by gel permeation chromatography (GPC). The molecular weight measurement by GPC is performed using GPC & HLC-8120 GPC, manufactured by Tosoh Corporation as a measuring device, Column TSK gel Super HM-M (15 cm), manufactured by Tosoh Corporation, and a tetrahydrofuran (THF) solvent. The weight average molecular weight and the number average molecular weight are calculated by using a molecular weight calibration curve plotted from a monodisperse polystyrene standard sample from the results of the foregoing measurement.

The content of the binder resin is, for example, preferably from 40% by weight to 95% by weight, more preferably from 50% by weight to 90% by weight, and still more preferably from 60% by weight to 85% by weight, with respect to the entire fluorescent resin particles or colored resin particles.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is further preferably from 60° C. to 100° C.

The melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably from 1% by weight to 20% by weight, and more preferably from 5% by weight to 15% by weight with respect to the entire fluorescent resin particles or colored resin particles.

—Other Additives—

Examples of other additives include well-known additives such as a magnetic material, an electrostatic charge-control agent, and an inorganic powder. These additives are included in the fluorescent resin particles or the colored resin particles as internal additives.

—Characteristics of Fluorescent Resin Particle or Colored Resin Particle—

The fluorescent resin particle or colored resin particle may be a resin particle having a singlelayer structure, or may be a resin particle (core-shell type particle) having a so-called core-shell structure formed of a core (core particle) and a coating layer (shell layer) covering the core. The resin particle having a core-shell structure includes, for example, a core containing a binder resin and, as needed, a coloring agent and a release agent, and a coating layer containing the binder resin.

(External Additives)

In a case where the fluorescent resin particle or the colored resin particle is used as an electrostatic charge image developing toner described below, the fluorescent resin particle or the colored resin particle may contain an external additive, as needed.

Further, the fluorescent resin particle or the colored resin particle used in the exemplary embodiment may be a resin particle having no external additive, or a resin particle externally added with an external additive.

Examples of the external additive include an inorganic particle. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particle to be used as the external additive may be subjected to a treatment with hydrophobizing agent. The hydrophobization treatment is performed, for example, by immersing inorganic particles in a hydrophobization treating agent. The hydrophobization treating agent is not particularly limited, and examples thereof include a silane coupling agent, a silicone oil, a titanate coupling agent, and an aluminum coupling agent. These may be used alone or two or more kinds thereof may be used in combination.

The amount of the hydrophobization treating agent is generally, for example, from 1 part by weight to 10 parts by weight respect to 100 parts by weight of the inorganic particles.

Examples of the external additives include a resin particle (a resin particle such as polystyrene, polymethyl methacrylate (PMMA), and a melamine resin), and a cleaning aid (such as a metal salt of higher fatty acid represented by zinc stearate, and a particle of a fluorine polymer).

The external addition amount of the external additive is preferably from 0.01% by weight to 10% by weight, and more preferably from 0.01% by weight to 6% by weight, with respect to the fluorescent resin particle or the colored resin particle.

<Use of Resin Particle Set>

The resin particle set according to the exemplary embodiment is preferably used as an image-forming resin particle set, and more preferably used as an electrostatic charge image developing toner set. In this case, the electrostatic charge image developing toner set preferably includes a fluorescent color toner containing a fluorescent coloring agent; and a colored toner containing a colored coloring agent, in which a volume average particle diameter of the fluorescent color toner is larger than a volume average particle diameter of the colored toner and an average circularity of the fluorescent color toner is 0.93 or more.

Further, the resin particle set according to the exemplary embodiment is also suitably used as a powder coating set. It is also possible to coat the surface to be coated with the powder coating set and then heat (bake) the surface to form a coating film that hardens the powder, and use it to produce a coated product. At this time, coating and heating (baking) may be performed collectively.

For the powder coating, well-known coating methods such as spray coating, electrostatic powder coating, triboelectric powder coating, and fluidized dipping may be used. The thickness of a powder coated film is preferably from 30 μm to 50 μm.

The heating temperature (baking temperature) is, for example, preferably from 90° C. to 250° C., more preferably from 100° C. to 220° C., and still more preferably from 120° C. to 200° C. The heating time (baking time) is adjusted by the heating temperature (baking temperature).

A target article to be coated with the powder is not particularly limited, and various kinds of metal components, ceramic components, resin components, and the like may be mentioned. These target articles may be unformed materials before being formed into the respective articles such as plate-like articles and linear articles, or may be formed articles which are formed for electronic components, road vehicles, building interior or exterior materials. Further, the target article may be an article whose surface to be coated has been subjected to a surface treatment, such as a primer treatment, a plating treatment or an electrodeposition coating treatment, in advance.

Besides, in fields other than coating, the resin particle set according to the exemplary embodiment is also suitably used as a resin particle set for a toner display.

A toner display is known in which charged resin particles are dispersed in a medium (generally, air) and an image is displayed by moving the resin particles by an electric field, and this method also be applicable to the resin particle set without problems. For example, an image is displayed by placing the resin particles in a cell sandwiched between two transparent electrodes and applying a voltage to move the resin particle.

[Method for Producing Fluorescent Resin Particle or Colored Resin Particle]

Next, a method for producing the fluorescent resin particle or the colored resin particle will be described.

After producing the fluorescent resin particle or the colored resin particle, the fluorescent resin particle or the colored resin particle used in the exemplary embodiment may be externally added with an external additive to the resin particle, as needed.

The fluorescent resin particle or the colored resin particle may be produced by using any one of a drying method (for example, a kneading and pulverizing method) and a wetting method (for example, an aggregation and coalescence method, a suspension polymerization method, and a dissolution suspension method). These methods of the toner particles are not particularly limited, and well-known method may be employed. Among them, the fluorescent resin particle or the colored resin particle may be suitably obtained by using the aggregation and coalescence method.

Specifically, for example, in a case where the fluorescent resin particle or colored resin particle is produced by using the aggregation and coalescence method, the fluorescent resin particle or colored resin particle is produced through the following steps. The steps include a step (a resin particle dispersion preparing step) of preparing a resin particle dispersion in which resin particles constituting the binder resin are dispersed, a step (an aggregated particle forming step) of forming aggregated particles by aggregating the resin particles (other particles if necessary) in the resin particle dispersion (in the dispersion in which other particle dispersions are mixed, if necessary), and a step (a coalescence step) of forming a fluorescent resin particle or a colored resin particle by coalescing aggregated particles by heating an aggregated particle dispersion in which aggregated particles are dispersed.

Hereinafter, the respective steps will be described in detail.

In the following description, a method of obtaining a resin particle including a coloring agent and a release agent will be described; however, the coloring agent and the release agent are used as needed. Other additives other than the coloring agent and the release agent may also be used.

Further, in the following description, examples of the coloring agent include at least one coloring agent selected from the group consisting of the fluorescent coloring agent and the colored coloring agent. In addition, as the coloring agent particle dispersion, a fluorescent coloring agent particle dispersion, a colored coloring agent particle dispersion, or a dispersion containing a fluorescent coloring agent particle and a colored coloring agent particle is preferably used.

—Resin Particle Dispersion Preparing Step—

Along with a resin particle dispersion in which the resin particles corresponds to the binder resins containing the crystalline polyester resin are dispersed, for example, a coloring agent particle dispersion in which coloring agent particles are dispersed, and a release agent particle dispersion in which the release agent particles are dispersed are prepared.

The resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion-exchange water, or the like, alcohols, and the like. The medium may be used alone or two or more kinds thereof may be used in combination.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyhydric alcohol. Among them, anionic surfactants and cationic surfactants are particularly preferable. The nonionic surfactant may be used in combination with the anionic surfactant or the cationic surfactant.

Among them, it is preferable to use a nonionic surfactant, and it is preferable to use a nonionic surfactant in combination with an anionic surfactant or a cationic surfactant.

The surfactants may be used alone or two or more kinds thereof may be used in combination.

For the resin particle dispersion, as a method of dispersing the resin particles in the dispersion medium, a common dispersing method by using, for example, a rotary shearing-type homogenizer, a ball mill having media, a sand mill, or a Dyno mill is exemplified. Further, depending on the kinds of the resin particles, the resin particles may be dispersed in a dispersion medium by a phase inversion emulsification method. The phase inversion emulsification method is a method of dispersing a resin in an aqueous medium in a particle form by dissolving a resin to be dispersed in a hydrophobic organic solvent in which the resin is soluble, conducting neutralization by adding a base to an organic continuous phase (O phase), and performing phase inversion from W/O to O/W by charging the aqueous medium (W phase) thereinto.

The volume average particle diameter of the resin particles dispersed in the resin particle dispersion is, for example, preferably from 0.01 μm to 1 μm, more preferably from 0.08 μm to 0.8 μm, and still more preferably from 0.1 μm to 0.6 μm.

Regarding the volume average particle diameter of the resin particles, a cumulative distribution by volume is drawn from the side of the smallest diameter with respect to particle diameter ranges (channels) splited using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is set as a volume average particle diameter $D_{50v}$. Note that, the volume average particle diameter of the particles in other dispersion liquids is also measured in the same manner.

The content of the resin particles contained in the resin particle dispersion is preferably from 5% by weight to 50% by weight, and more preferably from 10% by weight to 40% by weight.

The coloring agent particle dispersion and the release agent particle dispersion are also prepared in the same manner as in the preparation of the resin particle dispersion. That is, the volume average particle diameter, dispersion medium, the dispersing method, and the content of the particles for the resin particle dispersion are applicable to those for the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed with each other.

In addition, in the mixed dispersion, the resin particle, the coloring agent particle, and the release agent particle are heteroaggregated, and thereby an aggregated particle which has a diameter close to a targeted diameter of the fluorescent resin particle or the colored resin particle and contains the resin particle, the coloring agent particle, and the release agent particle is formed.

Specifically, for example, an aggregating agent is added to the mixed dispersion and a pH of the mixed dispersion is adjusted to acidicity (for example, the pH is from 2 to 5). A dispersion stabilizer is added as needed. Then, the mixed dispersion is heated at a temperature around a glass-transition temperature of the resin particles (specifically, for example, from glass-transition temperature of the resin particles—30° C. to glass-transition temperature of the resin particles—10° C.) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to acidicity (for example, the pH is from 2 to 5), a dispersion stabilizer may be added as needed, and then the heating may be performed.

Examples of the aggregating agent include a surfactant having an opposite polarity to the polarity of the surfactant contained in the mixed dispersion, an inorganic metal salt, and a divalent or more metal complex. When a metal complex is used as the aggregating agent, the use amount of the surfactant is reduced and charging properties are improved.

Along with the aggregating agent, an additive for forming a complex with an metal ion of the aggregating agent or forming a bond similar therero may be used, as needed. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid; and aminocarboxylic acid such as iminodiacetic acid (IDA), nitrilotriacetic acid (NTA), and ethylenediaminetetraacetic acid (EDTA).

The additive amount of the aggregating agent is, for example, preferably from 0.01 parts by weight to 5.0 parts by weight, and more preferably equal to or greater than 0.1 parts by weight and less than 3.0 parts by weight, with respect to 100 parts by weight of resin particle.

—Coalescence Step—

Next, the aggregated particle dispersion in which the aggregated particles are dispersed is heated at, for example, a temperature that is equal to or higher than the glass-transition temperature of the resin particles (for example, a temperature that is higher than the glass-transition temperature of the resin particles by 30° C. to 50° C.) and a melting temperature of the release agent or higher to perform the coalesce on the aggregated particles and form a fluorescent resin particle or a colored resin particle.

In the coalescence step, the resin and the release agent are in a state of being integrated at the glass-transition temperature of the resin particles or higher and the melting temperature of the release agent or higher. Then, the resin particles is cooled to obtain the fluorescent resin particle or the colored resin particle.

As a method of adjusting the aspect ratio of the release agent in the fluorescent resin particle or the colored resin particle, crystal growth may be carried out by keeping the temperature around the freezing point of the release agent for a certain time during cooling, or the crystal growth during cooling may be promoted and adjusted by using two or more release agents having different melting temperatures.

Through the above steps, the fluorescent resin particle or the colored resin particle is obtained.

Note that, the fluorescent resin particles or colored resin particles may be prepared through a step of forming a second aggregated particles in such a manner that an aggregated particle dispersion in which the aggregated particles are dispersed is obtained, the aggregated particle dispersion and a resin particle dispersion in which resin particles are dispersed are mixed to cause aggregation such that the resin particles attach on the surface of the aggregated particle, and a step of forming the fluorescent resin particle or the colored resin particle having a core-shell structure by heating the second aggregated particle dispersion in which the second aggregated particles are dispersed, and coalescing the second aggregated particles.

Here, after the coalescence step ends, the fluorescent resin particle or the colored resin particle formed in the solution is subjected to a washing step, a solid-liquid separation step, and a drying step, that are well known, and thus the fluorescent resin particle or the colored resin particle in a dry state is obtained. In the washing step, displacement washing using ion-exchanged water may be sufficiently performed from the viewpoint of charging properties. In the solid-liquid separation step, suction filtration, pressure filtration, or the like may be performed from the viewpoint of productivity. In the drying step, freeze drying, airflow drying, fluidized drying, vibration-type fluidized drying, or the like may be performed from the viewpoint of the productivity.

Then, the fluorescent resin particle or the colored resin particle is produced, for example, by adding and mixing an external additive to the obtained dried fluorescent resin particle or colored resin particle, as needed. The mixing may be performed by using, for example, a V blender, a HENSCHEL mixer, a LOEDIGE mixer, or the like. Furthermore, as needed, coarse particles of the fluorescent resin particle or the colored resin particle may be removed by using a vibration sieving machine, a wind classifier, or the like.

<Electrostatic Charge Image Developer Set>

In a case where the resin particle set according to the exemplary embodiment is used as an electrostatic charge image developer set, it may be a one-component developer containing only the fluorescent resin particle or the colored resin particle, or may be a two-component developer in which the fluorescent resin particle or the colored resin particle and a carrier are mixed.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin formed by containing an organosiloxane bond or the modified product thereof, a fluorine resin, polyester, polycarbonate, a phenol resin, and an epoxy resin.

The coating resin and the matrix resin may contain other additives such as conductive particles.

Examples of the conductive particle include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives as needed are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the resin particle (electrostatic charge image developing toner) to carrier in the two-component developer is preferably the resin particle (electrostatic charge image developing toner): carrier=1:100 to 30:100, and more preferably 3:100 to 20:100.

<Image Forming Apparatus and Image Forming Method>

An image forming apparatus and an image forming method in a case of using the resin particle set according to the exemplary embodiment is used as an electrostatic charge image developing toner set will be described.

The image forming apparatus includes a first image forming unit that forms a fluorescent color image of the fluorescent color toner in the toner set, a second image forming unit that forms a colored image of the colored toner of the toner set, a transfer unit that transfers the fluorescent image and the colored image onto a recording medium, and a fixing unit that fixes the fluorescent color image and the colored image on the recording medium.

Further, as each of the first and second image forming units, the image forming apparatus may be provided with an image forming unit, an image holding member, a charging unit that charges the surface of the image holding member, an electrostatic charge image forming unit that forms an electrostatic charge image on the charged surface of the image holding member, and a developing unit that develops the electrostatic charge image formed on the surface of the image holding member as a toner image by using the electrostatic charge image developer.

Further, the image holding member, the charging unit that charges the surface of the image holding member, the electrostatic charge image forming unit that forms an electrostatic charge image on the surface of the charged image holding member, and as the first and second image forming units, first and second developing units that each develops, as a toner image, an electrostatic charge image formed on the surface of the image holding member by the electrostatic charge image developer may be used for the apparatus.

In such an image forming apparatus, an image forming method includes a first image forming step of forming a fluorescent color image of the fluorescent color toner in the toner set, a second image forming step of forming a colored image of the colored toner of the toner set, a transfer step of transferring the fluorescent image and the colored image onto a recording medium, and a fixing step of fixing the fluorescent color image and the colored image on the recording medium.

As the image forming apparatus according to the exemplary embodiment, well-known image forming apparatuses such as an apparatus including a direct-transfer type device that directly transfers a toner image (fluorescent color image, and colored image in the exemplary embodiment) formed on a surface of the image holding member to a recording medium; an intermediate transfer type apparatus that primarily transfers the toner image formed on the surface of the image holding member to a surface of an intermediate transfer member, and secondarily transfers the toner image transferred to the surface of the intermediate transfer member to the surface of the recording medium; an apparatus including a cleaning unit that cleans the surface of the image holding member before being charged and after transferring the toner image; and an apparatus including an erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, a first transfer unit that primarily transfers the toner image formed on the surface of the image holding member to the surface of the intermediate transfer member, and a second transfer unit that secondarily transfers the toner image formed on the surface of the intermediate transfer member to the surface of the recording medium.

Hereinafter, an example of the image forming apparatus will be described. In the following description, main parts illustrated in the drawings will be described, and the description of the other parts will not be repeated.

FIG. 1 is a schematic configuration diagram illustrating an image forming apparatus used in the exemplary embodiment, and is a diagram illustrating an image forming apparatus of a quintuple tandem system and an intermediate transfer system.

The image forming apparatus as illustrated in FIG. 1 is provided with electrophotographic first to fifth image forming units 150Y, 150M, 150C, 150K, and 150B (image forming unit) that output an image of each color of yellow (Y), magenta (M), cyan (C), black (K), and fluorescent color (B) based on color separated image data. These image forming units (hereinafter, referred to simply as "units" in some cases) 150Y, 150M, 150C, 150K, and 150B are arranged in parallel in the horizontal direction with a predetermined distance therebetween. These units 150Y, 150M, 150C, 150K, and 150B may be a process cartridge which is detachable from the image forming apparatus.

Under the units 150Y, 150M, 150C, 150K, and 150B, an intermediate transfer belt (an example of an intermediate transfer member) 133 is extended through each unit. The intermediate transfer belt 133 is wound around a drive roll 113, a support roll 112, and a facing roll 114 that are in contact with the inner surface of the intermediate transfer belt 133, and travels in a direction from the first unit 150Y to the fifth unit 150B (direction of arrow B in FIG. 1). An intermediate transfer member cleaning device 116 is provided on the side surface of the image holding surface side of the intermediate transfer belt 133 so as to face the drive roll 113. Further, on the upstream side of the intermediate transfer belt 133 in the rotational direction with respect to the intermediate transfer member cleaning device 116, a voltage application device 160 that generates an electric field between the intermediate transfer belt 133 and the voltage application device 160 by generating a potential difference between the support roll 113 and the voltage application device 160.

Each of yellow, magenta, cyan, black, and fluorescent color toners contained in each of toner cartridges 140Y, 140M, 140C, 140K, and 140B is supplied to each of developing machines (an example of developing units) 120Y, 120M, 120C, 120K, and 120B in each of units 150Y, 150M, 150C, 150K, and 150B.

Since the first to fifth units 150Y, 150M, 150C, 150K, and 150B have the same configuration, operation, and action, here, the first unit 150Y that forms a yellow image disposed on the upstream side in the traveling direction of the intermediate transfer belt will be described as a representative.

The first unit 150Y includes a photoreceptor 111Y which functions as an image holding member. Around the photoreceptor 111Y, a charging roll (an example of the charging unit) 118Y that charges the surface of the photoreceptor 111Y to a predetermined potential, an exposure device (an example of the electrostatic charge image forming unit) 119Y that forms an electrostatic charge image by exposing the surface with a laser beam based on a color separated image signal, a developing machine (an example of the developing unit) 120Y that develops an electrostatic charge image by supplying toner charged to the electrostatic charge image, a first transfer roll 117Y (an example of the first transfer unit) that transfers the developed toner image onto the intermediate transfer belt 133, and a photoreceptor cleaning device (an example of the cleaning unit) 115Y that removes the toner remaining on the surface of the photoreceptor 111Y after first transfer are arranged in order.

The first transfer roll 117Y is disposed on the inner side of the intermediate transfer belt 133, and is provided at a position facing the photoreceptor 111Y. Further, a bias power supply (not shown) for applying a first transfer bias is connected to each of the first transfer rolls 117Y, 117M, 117C, 117K, and 117B of the units. Each bias power supply varies the value of transfer bias applied to each first transfer roll under the control of a controller (not shown).

Hereinafter, an operation of forming a yellow image in the first unit 150Y will be described.

First, prior to the operation, the surface of the photoreceptor 111Y is charged to a potential of −600 V to −800 V by the charging roll 118Y.

The photoreceptor 111Y is formed by laminating a photosensitive layer on a conductive (for example, volume resistivity at 20° C.: $1\times10^{-6}$ Ωcm or less) substrate. This photosensitive layer generally has high resistance (resistance of general resin), but has the property that the specific resistance of the portion irradiated with the laser beam changes when the laser beam is irradiated. Therefore, the surface of the charged photoreceptor 111Y is irradiated with the laser beam from an exposure device 119Y in accordance with the image data for yellow sent from the controller (not shown). As a result, an electrostatic charge image having a yellow image pattern is formed on the surface of the photoreceptor 111Y.

The electrostatic charge image is an image formed on the surface of the photoreceptor 111Y by charging, and is a so-called negative latent image formed in such a manner that the specific resistance of the irradiated portion of the photosensitive layer is reduced by the laser beam from the exposure device 119Y, and the electric charge charged on the surface of the photoreceptor 111Y flows, and the charge of the portion with which the laser beam is not irradiated remains.

The electrostatic charge image formed on the photoreceptor 111Y is rotated to a predetermined development position as the photoreceptor 111Y travels. Then, at this development position, the electrostatic charge image on the photoreceptor 111Y is developed and made visible as a toner image by the developing machine 120Y.

In the developing machine 120Y, for example, an electrostatic charge image developer containing at least a yellow toner and a carrier is stored. The yellow toner is frictionally charged by being agitated inside the developing machine 120Y, and is held on a developer roll (an example of the developer holding member) with a charge of the same polarity (negative polarity) as the charged electric charge on the photoreceptor 111Y. Then, as the surface of the photoreceptor 111Y passes through the developing machine 120Y, the yellow toner is electrostatically attached to a latent image portion on the surface of the photoreceptor 111Y, and the latent image is developed by the yellow toner. The photoreceptor 111Y on which a yellow toner image is formed is subsequently traveled at a predetermined speed, and the toner image developed on the photoreceptor 111Y is transported to a predetermined first transfer position.

When the yellow toner image on the photoreceptor 111Y is transported to a position of the first transfer, the first transfer bias is applied to the first transfer roll 117Y, the electrostatic force from the photoreceptor 111Y toward the first transfer roll 117Y acts on the toner image, and the toner image on the photoreceptor 111Y is transferred onto the intermediate transfer belt 133. The transfer bias applied at this time is (+) polarity opposite to polarity (−) of the toner, and for example, in the first unit 150Y, it is controlled to +10 μA by the controller (not shown).

On the other hand, the toner remaining on the photoreceptor 111Y is removed and collected by a photoreceptor cleaning device 115Y.

The first transfer bias applied to the first transfer rolls 117M, 117C, 117K, and 117B after a second unit 150M is also controlled according to the first unit.

In this way, the intermediate transfer belt 133 to which the yellow toner image is transferred in the first unit 150Y is sequentially transported through the second to fifth units 150M, 150C, 150K, and 150B and the toner images of the respective colors are superimposed and multiply transferred.

The intermediate transfer belt 133 on which toner images of five colors are multiply transferred through the first to fifth units leads to a second transfer portion configured to include the intermediate transfer belt 133 and the facing roll 114 in contact with the inner surface of the intermediate transfer belt and a second transfer roll (an example of a second transfer unit) 134 disposed on the image holding surface side of the intermediate transfer belt 133. On the other hand, the recording sheet (an example of the recording medium) P is fed at a predetermined timing to the gap where the second transfer roll 134 and the intermediate transfer belt 133 are in contact with each other via a supply mechanism, and the second transfer bias is applied to the facing roll 114. The transfer bias applied at this time is the same polarity (−) as the polarity (−) of the toner, and the electrostatic force from the intermediate transfer belt 133 to a recording sheet P acts on the toner image such that the toner image is transferred onto the recording sheet P on the intermediate transfer belt 133. The second transfer bias at this time is determined according to the resistance detected by the resistance detection unit (not shown) that detects the resistance of the second transfer portion, and is voltage controlled.

Thereafter, the recording sheet P is sent to the press-contact portion (nip portion) of a pair of fixing rolls in the fixing device (an example of the fixing unit) 135, the toner image is fixed on the recording sheet P, and a fixed image is formed.

Examples of the recording sheet P to which the toner image is transferred include plain paper used for an electrophotographic copying machine and a printer. As the recording medium, in addition to the recording sheet P, an OHP sheet or the like may be mentioned.

In order to further improve the smoothness of the image surface after fixation, the surface of the recording sheet P is also preferably smooth, for example, coated paper in which the surface of plain paper is coated with resin or the like and art paper for printing are preferably used.

The recording sheet P for which the fixing of the color image is completed is transported toward an ejection section, and the series of color image forming operations is completed.

The image forming apparatus as illustrated in FIG. 1 has such a configuration that the toner cartridges 140Y, 140M, 140C, 140K, and 140B are detachable therefrom, and the developing machines 120Y, 120M, 120C, 120K, and 120B are connected to the toner cartridges corresponding to the respective developing machines (colors) via toner supply tubes (not shown), respectively. In addition, in a case where the toner stored in the toner cartridge runs low, the toner cartridge is replaced.

<Process Cartridge and Toner Cartridge Set>

A process cartridge in a case of using the resin particle set according to the exemplary embodiment is used as an electrostatic charge image developing toner set will be described.

The process cartridge includes a first developing unit that stores a first electrostatic charge image developer of the electrostatic charge image developer set and a second developing unit that stores a second electrostatic charge image developer of the electrostatic charge image developer set according to the exemplary embodiment, and is detachable from the image forming apparatus.

The process cartridge is not limited to the above-described configuration, and may be configured to include a developing machine and at least one selected from other units such as an image holding member, a charging unit, an electrostatic charge image forming unit, and a transfer unit as needed.

Hereinafter, an example of the process cartridge will be described. However, the process cartridge is not limited thereto. Major parts shown in the drawing will be described, but descriptions of other parts will be omitted.

Figure 2:
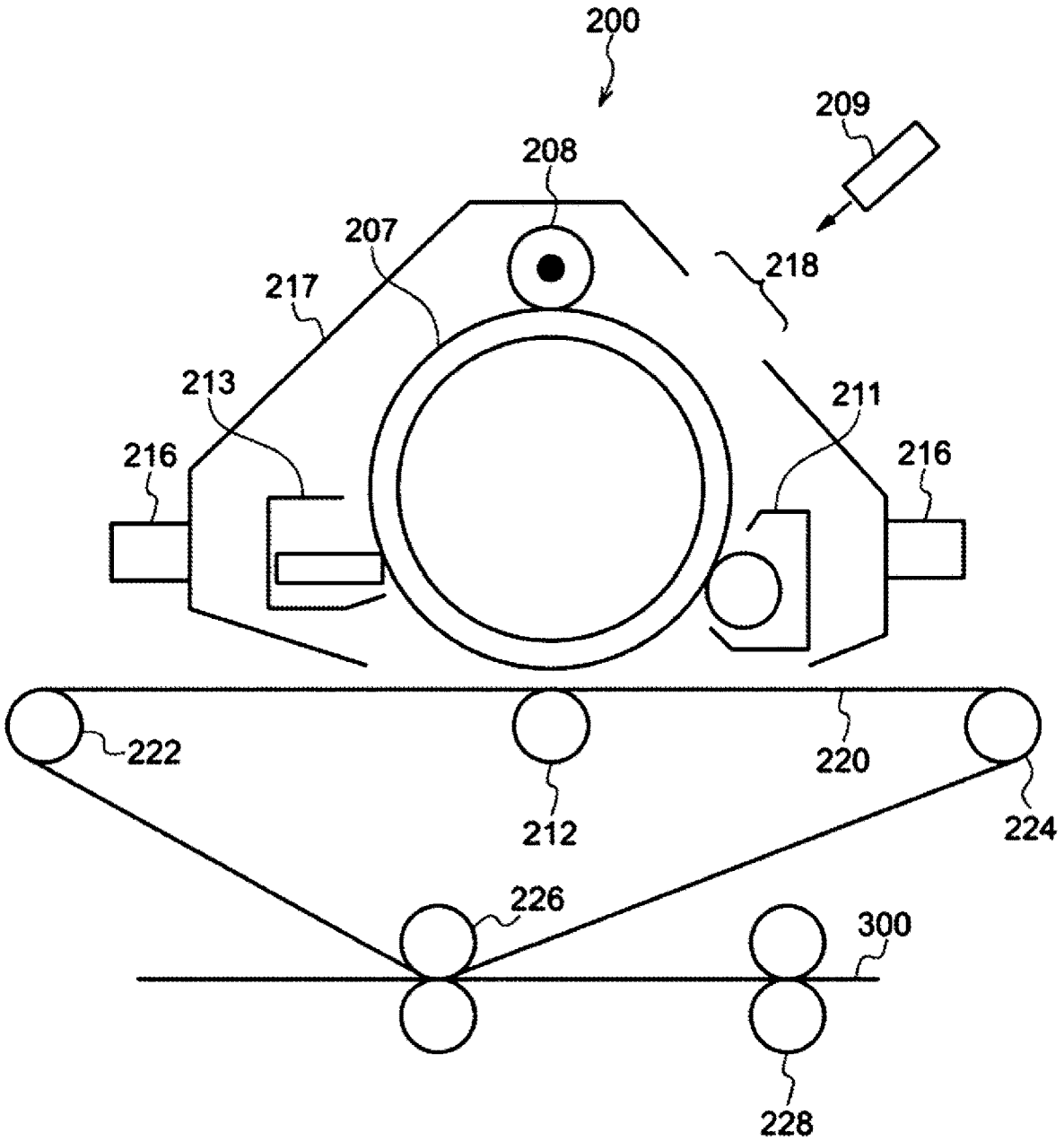
FIG. 2 is a configuration diagram illustrating an example of a process cartridge used in the exemplary embodiment.

FIG. 2 is a configuration diagram illustrating the process cartridge used in the exemplary embodiment.

The process cartridge 200 illustrated in FIG. 2 is configured such that a photoreceptor 207 (an example of the image holding member), a charging roll 208 (an example of the charging unit) which is provided in the vicinity of the photoreceptor 207, a developing machine 211 (an example of the developing unit), and a photoreceptor cleaning device 213 (an example of the cleaning unit) are integrally formed in combination, and are held by a housing 217 which is provided with a mounting rail 216 and an opening portion 218 for exposing light.

In FIG. 2, 209 is an exposure device (an example of electrostatic charge image forming unit), 212 is a first transfer roll (an example of first transfer unit), 220 is an intermediate transfer belt (an example of an intermediate transfer member), 222 is a drive roll that also serves as an intermediate transfer belt charge erasing unit (an example of an intermediate transfer member charge erasing unit), 224 is a support roll, 226 is a secondary transfer roll (an example of secondary transfer unit), 228 is a fixing device (an example of fixing unit), and 300 is a recording sheet (an example of a recording medium).

Next, a toner cartridge set in a case of using the resin particle set according to the exemplary embodiment is used as an electrostatic charge image developing toner set will be described.

The toner cartridge set includes a first toner cartridge that stores a fluorescent color toner in the toner set and a second toner cartridge that stores the colored toner in the toner set, and is detachable from the image forming apparatus.

Each of the toner cartridges stores the toner for replenishment for being supplied to each of the developing units provided in the image forming apparatus.

EXAMPLES

Hereinafter, examples of the present disclosure will be described, but the present disclosure is not limited to the following examples. In addition, both "parts" and "/o" are on a weight basis unless otherwise specified.

Example 1

Preparation of Fluorescent Coloring Agent Particle Dispersion (1)

Fluorescent coloring agent (Basic Violet 11:1): 70 parts
Anionic surfactant (NEOGEN RK, produced by Daiichi Kogyo Seiyaku Co., Ltd.): 30 part
Ion-exchanged water: 200 parts The above materials are mixed and dispersed for 10 minutes using a homogenizer (ULTRA TURRAX T50 manufactured by IKA Corporation). The ion-exchanged water is added thereto such that the solid content in the dispersion is 20% by weight, and thereby a fluorescent coloring agent particle dispersion (1) in which coloring agent particles having a volume average particle diameter of 140 nm are dispersed is obtained.

<Preparation of Fluorescent Coloring Agent Particle Dispersion (2)>

A fluorescent coloring agent particle dispersion (2) is obtained in the same manner as in the preparation of the fluorescent coloring agent particle dispersion (1) except that 70 parts of the fluorescent coloring agent (Basic Violet 11:1) is changed to 70 parts of the fluorescent coloring agent (Basic Red 1:1).

Preparation of Colored Coloring Agent Particle Dispersion (1)

Colored coloring agent (C.I. Pigment Red 122): 70 parts
Anionic surfactant (NEOGEN RK, produced by Daiichi Kogyo Seiyaku Co., Ltd.): 30 part
Ion-exchanged water: 200 parts The above materials are mixed and dispersed for 10 minutes using a homogenizer (ULTRA TURRAX T50 manufactured by IKA Corporation). The ion-exchanged water is added thereto such that the solid content in the dispersion is 20% by weight, and thereby a colored coloring agent particle dispersion (1) in which coloring agent particles having a volume average particle diameter of 140 nm are dispersed is obtained.

Preparation of Resin Particle Dispersion (1)

Terephthalic acid: 30 parts by mole
Fumaric acid: 70 parts by mole
Bisphenol A ethylene oxide adduct: 5 parts by mole
Bisphenol A propylene oxide adduct: 95 parts by mole The above-described materials are put into a flask equipped with a stirrer, a nitrogen inlet pipe, a temperature sensor, and a rectification column, the temperature of the flask is raised up to 220° C. over one hour, and then 1 part of titanium tetraethoxide is put into 100 parts of the above materials. While distilling off water generated, the temperature is raised up to 230° C. over 30 minutes, dehydration condensation reaction is continued for one hour at the temperature, and the obtained reaction product is cooled. In this way, a polyester resin having a weight average molecular weight of 18,000 and a glass-transition temperature of 60° C. is obtained.

40 parts of ethyl acetate and 25 parts of 2-butanol are put into a container provided with a temperature controller and a nitrogen replacement unit to prepare a mixed solvent, then 100 parts of polyester resin (1) is slowly put into the container and dissolved, and 10% by weight of ammonia aqueous solution (equivalent to three times the acid value of the resin by a molar ratio) is put into the container and stirred for 30 minutes. Subsequently, the interior of the container is replaced with dry nitrogen, 400 parts of ion-exchange water is added dropwise at a rate of 2 parts per minute while maintaining the temperature at 40° C. and stirring the mixed solution. After completing the dropwise addition, the temperature is returned to room temperature (20° C. to 25° C.), and bubbling with dry nitrogen is performed for 48 hours with stirring, and thus the content of ethyl acetate and 2-butanol is reduced to 1,000 ppm or less, and thereby a resin particle dispersion is obtained. The ion-exchanged water is added to the resin particle dispersion to adjust the solid content to 20% by weight, and thereby a resin particle dispersion (1) is obtained.

Preparation of release agent particle Dispersion (1)

Paraffin wax (HNP-9, prepared by Nippon Seiro Co., Ltd.): 100 parts
Anionic surfactant (NEOGEN RK, produced by Daiichi Kogyo Seiyaku Co., Ltd.): 1 part
Ion-exchanged water: 350 parts The above-described materials are mixed with each other, the mixture is heated at 100° C., is dispersed by using a homogenizer (trade name, ULTRA TURRAX T50, manufactured by IKA Ltd.), and then is subjected to a dispersion treatment by using Manton-Gaulin high-pressure homogenizer (manufactured by Manton Gaulin Mfg Company Inc), thereby obtaining a release agent particle dispersion (1) (solid content 20% by weight) in which a release agent particle having a volume average particle diameter of 200 nm is dispersed.

Preparation of Fluorescent Color Toner Particle (1)

Resin particle dispersion (1): 60.05 parts
Fluorescent coloring agent particle dispersion (1): 1.00 parts
Colored coloring agent particle dispersion (1): 0.20 parts
Release agent particle dispersion (1): 10.00 parts
Anionic surfactant (NEOGEN RK, 20%, produced by Daiichi Kogyo Seiyaku Co., Ltd.): 0.75 parts The above-described materials are put into a round stainless steel flask, 0.1 N (=mol/L) of sulfuric acid is added to the flask to adjust the pH to 3.5, and then 30 parts of a nitric acid aqueous solution having a polyaluminum chloride concentration of 10% by weight is added. Then, the mixture is dispersed at 30° C. by using a homogenizer (ULTRA TURRAX T50, manufactured by IKA Ltd.), and then is heated at 45° C. and kept for 30 minutes in the oil bath for heating. After that, 28.00 parts of the resin particle dispersion (1) is added and kept for 1 hour, 0.1 N sodium hydroxide aqueous solution is added thereto to adjust the pH to 8.5, and the resultant is heated to 84° C. and kept for 2.5 hours. Thereafter, the mixture is cooled to 20° C. at a rate of 20° C./min, the solid content is filtered out, and sufficiently washed with ion-exchanged water and dried to obtain a fluorescent color toner particle (1). The volume average particle diameter of the fluorescent color toner particles (1) is 5.80 μm.

<Preparation of Carrier 1>

Ferrite particle (average particle diameter of 35 μm): 100 parts

Toluene: 14 parts

Polymethylmethacrylate (MMA, weight average molecular weight of 75,000): 5 parts Carbon black:0.2 parts (VXC-72, prepared by Cabot, volume resistivity: 100 Ωcm or less)

The above materials except for ferrite particles are dispersed in a sand mill to prepare a dispersion, the dispersion, together with the ferrite particles, is introduced into a vacuum degassing type kneader, and stirring and drying under reduced pressure are performed to obtain the carrier 1.

Preparation of Fluorescent Color Toner (1)

100 parts by weight of the obtained fluorescent color toner particle (1), 1.5 parts by weight of hydrophobic silica (RY50, prepared by Nippon Aerosil Co., Ltd.) and 1.0% by weight of hydrophobic titanium oxide (T805, prepared by Nippon Aerosil Co., Ltd.) are mixed for 30 seconds at 10,000 rpm (revolutions per minute) with a sample mill. Thereafter, by sieving with a vibrating sieve having an opening of 45 μm, a fluorescent color toner (1) (electrostatic charge image developing toner) is prepared. The volume average particle diameter of the obtained fluorescent color toner (1) is 5.8 μm.

Preparation of Electrostatic Charge Image Developer 8 parts of the fluorescent color toner (1) and 92 parts of the carrier are mixed in a V blender to prepare a fluorescent color developer 1 (electrostatic charge image developer).

Preparation of Colored Coloring Agent Particle Dispersion (2)

Colored coloring agent (C.I. Pigment Yellow 74): 70 parts

Anionic surfactant (NEOGEN RK, produced by Daiichi Kogyo Seiyaku Co., Ltd.): 30 part Ion-exchanged water: 200 parts The above materials are mixed and dispersed for 10 minutes using a homogenizer (ULTRA TURRAX T50 manufactured by IKA Corporation). Ion-exchanged water is added thereto such that the solid content in the dispersion is 20% by weight to obtain a colored coloring agent particle dispersion (2) in which coloring agent particles having a volume average particle diameter of 140 nm are dispersed.

Preparation of Colored Coloring Agent Particle Dispersion (3)

A fluorescent coloring agent particle dispersion (3) is obtained in the same manner as in the preparation of the fluorescent coloring agent particle dispersion (1) except that 70 parts of the colored coloring agent (C.I. Pigment Red 122) is changed to 70 parts of the colored coloring agent (C.I. Pigment Blue 15:3).

Preparation of Colored Toner Particle (1)

Resin particle dispersion (1): 44.50 parts

Colored coloring agent particle dispersion (2): 7.00 parts

Release agent particle dispersion (1): 10.00 parts

Anionic surfactant (NEOGEN RK, 20%, produced by Daiichi Kogyo Seiyaku Co., Ltd.): 0.20 parts The above-described materials are put into a round stainless steel flask, 0.1 N (=mol/L) of sulfuric acid is added to the flask to adjust the pH to 3.5, and then 30 parts of a nitric acid aqueous solution having a polyaluminum chloride concentration of 10% by weight is added. Then, the mixture is dispersed at 30° C. by using a homogenizer (trade name, ULTRA TURRAX T50, manufactured by IKA Ltd.), and then is heated at 45° C. and kept for 10 minutes in the oil bath for heating. After that, 38.30 parts of the resin particle dispersion (1) is added and kept for 1 hour, 0.1 N sodium hydroxide aqueous solution is added thereto to adjust the pH to 8.5, and the resultant is heated to 84° C. and kept for 2.5 hours. Thereafter, the mixture is cooled to 20° C. at a rate of 20° C./min, the solid content is filtered out, and, sufficiently washed with ion-exchanged water and dried to obtain a colored toner particle (1). The volume average particle diameter of the colored toner particle (1) is 4.70 μm.

Preparation of Colored Toner (1)

100 parts by weight of the obtained colored toner particle (1), 1.5 parts by weight of hydrophobic silica (RY50, prepared by Nippon Aerosil Co., Ltd.) and 1.0% by weight of hydrophobic titanium oxide (T805, prepared by Nippon Aerosil Co., Ltd.) are mixed for 30 seconds at 10,000 rpm (revolutions per minute) with a sample mill. Thereafter, by sieving with a vibrating sieve having an opening of 45 μm, a colored toner (1) (electrostatic charge image developing toner) is prepared. The volume average particle diameter of the obtained colored toner (1) is 4.7 μm.

Preparation of Electrostatic Charge Image Developer 8 parts of the colored toner (1) and 92 parts of the carrier are mixed in a V blender to prepare a colored developer 1 (electrostatic charge image developer).

The obtained fluorescent color toner (1) and the colored toner (1) are used as the electrostatic charge image developing toner set of Example 1, and the obtained fluorescent color developer 1 and colored developer 1 are set as the electrostatic charge image developer set of Example 1.

Preparation of Fluorescent Color Toner Particle (2)

A fluorescent color toner particle (2) is prepared in the same manner as in the preparation of the fluorescent color toner particle (1) except that the mixture is heated to 45° C. in an oil bath for heating and kept for 40 minutes, and then heated to 84° C. and kept for 1.5 hours.

Preparation of Fluorescent Color Toner Particle (3)

A fluorescent color toner particle (3) is prepared in the same manner as in the preparation of the fluorescent color toner particle (1) except that the mixture is heated to 45° C. in an oil bath for heating and kept for 25 minutes.

Preparation of Fluorescent Color Toner Particle (4)

A fluorescent color toner particle (4) is prepared in the same manner as in the preparation of the fluorescent color toner particle (1) except that the mixture is heated to 45° C. in an oil bath for heating and kept for 60 minutes, and then heated to 84° C. and kept for 0.5 hours.

Preparation of Fluorescent Color Toner Particle (5)

A fluorescent color toner particle (5) is prepared in the same manner as in the preparation of the fluorescent color toner particle (1) except that the mixture is heated to 45° C. in an oil bath for heating and kept for 120 minutes, and then heated to 84° C. and kept for 1.0 hours.

Preparation of Fluorescent Color Toner Particle (6)

A fluorescent color toner particle (6) is prepared in the same manner as in the preparation of the fluorescent color toner particle (1) except that the mixture is heated to 45° C. in an oil bath for heating and kept for 90 minutes, and then heated to 84° C. and kept for 0.5 hours.

Preparation of Fluorescent Color Toner Particle (7)

A fluorescent color toner particle (7) is prepared in the same manner as in the preparation of the fluorescent color toner particle (1) except that 1.00 part of the fluorescent coloring agent particle dispersion (2) is changed to 1.00 part of the fluorescent coloring agent particle dispersion (2).

Preparation of Fluorescent Color Toner Particle (8)

A fluorescent color toner particle (8) is prepared in the same manner as in the preparation of the fluorescent color toner particle (1) except that the mixture is heated to 45° C. in an oil bath for heating and kept for 5 minutes.

Preparation of Fluorescent Color Toner Particle (9)

A fluorescent color toner particle (9) is prepared in the same manner as in the preparation of the fluorescent color toner particle (1) except that the content of the fluorescent coloring agent particle dispersion (1) is changed from 1.00 part to 1.10 parts.

Preparation of Colored Toner Particle (2)

A colored toner particle (2) is prepared in the same manner as in the preparation of the colored toner particle (1) except that the mixture is heated to 45° C. in an oil bath for heating and kept for 5 minutes.

Preparation of Colored Toner Particle (3)

A colored toner particle (3) is prepared in the same manner as in the preparation of the colored toner particle (1) except that the mixture is heated to 45° C. in an oil bath for heating and kept for 12 minutes.

Preparation of Colored Toner Particle (4)

A colored toner particle (4) is prepared in the same manner as in the preparation of the colored toner particle (1) except that the mixture is heated to 45° C. in an oil bath for heating and kept for 25 minutes.

Preparation of Colored Toner Particle (5)

A colored toner particle (5) is prepared in the same manner as in the preparation of the colored toner particle (1) except that the mixture is heated to 45° C. in an oil bath for heating and kept for 30 minutes.

Preparation of Colored Toner Particle (6)

A colored toner particle (6) is prepared in the same manner as in the preparation of the colored toner particle (1) except that the mixture is heated to 45° C. in an oil bath for heating and kept for 20 minutes.

Preparation of Colored Toner Particle (7)

A colored toner particle (7) is prepared in the same manner as in the preparation of the colored toner particle (1) except that 7.00 parts of the colored coloring agent particle dispersion (2) is changed to 5.0 parts of the colored coloring agent particle dispersion (3).

Example 2

A fluorescent color toner, a fluorescent color developer, a colored toner, and a colored developer are prepared in the same manner as in Example 1 except that the fluorescent color toner particle (1) is changed to the fluorescent color toner particle (2) and the colored toner particle (1) is changed to the colored toner particle (2) to prepare an electrostatic charge image developing toner set of Example 2 and an electrostatic charge image developer set of Example 2.

Example 3

A fluorescent color toner, a fluorescent color developer, a colored toner, and a colored developer are prepared in the same manner as in Example 1 except that the fluorescent color toner particle (1) is changed to the fluorescent color toner particle (3) and the colored toner particle (1) is changed to the colored toner particle (3) to prepare an electrostatic charge image developing toner set of Example 3 and an electrostatic charge image developer set of Example 3.

Example 4

A fluorescent color toner, a fluorescent color developer, a colored toner, and a colored developer are prepared in the same manner as in Example 1 except that the fluorescent color toner particle (1) is changed to the fluorescent color toner particle (7) to prepare an electrostatic charge image developing toner set of Example 4 and an electrostatic charge image developer set of Example 4.

Example 5

A fluorescent color toner, a fluorescent color developer, a colored toner, and a colored developer are prepared in the same manner as in Example 1 except that the fluorescent color toner particle (1) is changed to the fluorescent color toner particle (9) to prepare an electrostatic charge image developing toner set of Example 5 and an electrostatic charge image developer set of Example 5.

Example 6

A fluorescent color toner, a fluorescent color developer, a colored toner, and a colored developer are prepared in the same manner as in Example 1 except that the colored toner particle (1) is changed to the colored toner particle (7) to prepare an electrostatic charge image developing toner set of Example 6 and an electrostatic charge image developer set of Example 6.

Comparative Example 1

A fluorescent color toner, a fluorescent color developer, a colored toner, and a colored developer are prepared in the same manner as in Example 1 except that the fluorescent color toner particle (1) is changed to the fluorescent color toner particle (4) and the colored toner particle (1) is changed to the colored toner particle (4) to prepare an electrostatic charge image developing toner set of Comparative Example 1 and an electrostatic charge image developer set of Comparative Example 1.

Comparative Example 2

A fluorescent color toner, a fluorescent color developer, a colored toner, and a colored developer are prepared in the same manner as in Example 1 except that the fluorescent color toner particle (1) is changed to the fluorescent color toner particle (5) and the colored toner particle (1) is changed to the colored toner particle (5) to prepare an electrostatic charge image developing toner set of Comparative Example 2 and an electrostatic charge image developer set of Comparative Example 2.

Comparative Example 3

A fluorescent color toner, a fluorescent color developer, a colored toner, and a colored developer are prepared in the same manner as in Example 1 except that the fluorescent color toner particle (1) is changed to the fluorescent color toner particle (6) and the colored toner particle (1) is changed to the colored toner particle (6) to prepare an electrostatic charge image developing toner set of Comparative Example 3 and an electrostatic charge image developer set of Comparative Example 3.

Comparative Example 4

A fluorescent color toner, a fluorescent color developer, a colored toner, and a colored developer are prepared in the same manner as in Example 1 except that the fluorescent color toner particle (1) is changed to the fluorescent color toner particle (8) and the colored toner particle (1) is changed to the colored toner particle (4) to prepare an electrostatic charge image developing toner set of Comparative Example 4 and an electrostatic charge image developer set of Comparative Example 4.

The following evaluations are performed using the obtained electrostatic charge image developing toner sets of Examples 1 to 6 and Comparative Examples 1 to 4 or the electrostatic charge image developer set. The evaluation results are summarized in Table 1.

<Evaluation Method>

The obtained electrostatic charge image developing toner set and electrostatic charge image developer set are used to fill an image forming apparatus "DOCU CENTER COLOR 400", manufactured by Fuji Xerox Co., Ltd., respectively.

With this image forming apparatus, the colors of arbitrary nine portions in an output image obtained by outputting a two-color overlapping solid image having a fluorescent toner image density of 100% and a colored toner image density of 100% are measured by X-Rite 938 (aperture diameter of 4 mm) manufactured by X-Rite Inc., and L*a*b* values and the spectral reflectance (from 400 nm to 700 nm) are determined, and regarding the spectral reflectance, the maximum spectral reflectance in the wavelength region of 400 nm to 700 nm is determined.

—Evaluation of Color Reproducibility (in-Plane Color Difference)—

The difference between an average value of L*a*b* values measured at the nine portions and each of the values measured at the nine portions is calculated, and the maximum difference is regarded as a maximum color difference ΔE. Evaluation is performed according to the following criteria.

A: $0 \leq \Delta E < 1$

B: $1 \leq \Delta E < 2$

C: $2 \leq \Delta E < 3$

D: $3 \leq \Delta E$

—Fluorescence (Fluorescence Intensity) Evaluation—

The difference between the average value of the maximum spectral reflectance values measured at the nine portions and each of the values measured at the nine portions is calculated, and the maximum difference is regarded as a maximum difference ΔR. Evaluation is performed according to the following criteria.

A: $0 \leq \Delta R < 1$

B: $1 \leq \Delta R < 2$

C: $2 \leq \Delta R < 3$

D: $3 \leq \Delta R$

—Evaluation of Image Quality (Gradation, Roughness, and Image Loss)—

In addition, the test chart No. 5-1 of Soc. of Electrophotography of Japan is output by the image forming apparatus. 10 portions of the combination color halftone image part from +0.1 to +1.8 in the output image are measured with X-Rite 939 (aperture diameter of 4 mm) manufactured by X-Rite Inc. to obtain an L* value. Further, the toner applied amount ($g/m^2$) of the measured combination color halftone image portion is determined. Here, the L* value is plotted with respect to the toner applied amount ($g/m^2$), and the polynomial approximation of the second degree is performed to obtain R2 which is a square value of a correlation coefficient. The value of R2 is used and evaluated according to the following evaluation criteria.

A: $0.99 \leq R2 \leq 1.0$

B: $0.98 \leq R2 < 0.99$

C: $0.96 \leq R2 < 0.98$

D: $R2 < 0.96$

TABLE 1

| | Colored toner (colored resin particle) | | | | | Fluorescent color toner (fluorescent color resin particle) | | | |
|---|---|---|---|---|---|---|---|---|---|
| | No. | Colored coloring agent | Content (parts) | 45° C. keeping time (min) | Volume average particle diameter (μm) | No. | Fluorescent coloring agent | Content (parts) | 45° C. keeping time (min) |
| Example 1 | (1) | PY74 | 7.0 | 10 | 4.7 | (1) | BV11:1 | 1.0 | 30 |
| Example 2 | (2) | PY74 | 7.0 | 5 | 4.5 | (2) | BV11:1 | 1.0 | 40 |
| Example 3 | (3) | PY74 | 7.0 | 12 | 4.8 | (3) | BV11:1 | 1.0 | 25 |
| Example 4 | (1) | PY74 | 7.0 | 10 | 4.7 | (7) | BR1:1 | 1.0 | 30 |
| Example 5 | (1) | PY74 | 7.0 | 10 | 4.7 | (9) | BV11:1 | 1.1 | 30 |
| Example 6 | (7) | PB15:3 | 5.0 | 10 | 4.7 | (1) | BV11:1 | 1.0 | 30 |
| Comparative Example 1 | (4) | PY74 | 7.0 | 25 | 5.5 | (4) | BV11:1 | 1.0 | 60 |
| Comparative Example 2 | (5) | PY74 | 7.0 | 30 | 5.8 | (5) | BV11:1 | 1.0 | 120 |
| Comparative Example 3 | (6) | PY74 | 7.0 | 20 | 5.3 | (6) | BV11:1 | 1.0 | 90 |
| Comparative Example 4 | (4) | PY74 | 7.0 | 25 | 5.5 | (8) | BV11:1 | 1.0 | 5 |

| | Volume average particle diameter (μm) | 84° C. keeping time (min) | Average circularity | Volume proportion (%) of resin particles having particle diameter of 4 μm less | Evaluation results: Color reproducibility | Fluorescence intensity | Image quality |
|---|---|---|---|---|---|---|---|
| Example 1 | 5.8 | 2.5 | 0.96 | 3.0 | A | A | A |
| Example 2 | 6.0 | 1.5 | 0.93 | 3.0 | B | B | A |
| Example 3 | 5.5 | 2.5 | 0.96 | 5.0 | A | A | B |
| Example 4 | 5.7 | 2.5 | 0.96 | 3.0 | A | A | A |
| Example 5 | 5.8 | 2.5 | 0.96 | 3.0 | A | A | A |
| Example 6 | 5.8 | 2.5 | 0.96 | 3.0 | A | A | A |
| Comparative Example 1 | 6.7 | 0.5 | 0.90 | 5.0 | D | C | B |
| Comparative Example 2 | 7.5 | 1.0 | 0.91 | 7.2 | C | B | D |
| Comparative Example 3 | 7.1 | 0.5 | 0.90 | 7.2 | D | D | D |
| Comparative Example 4 | 4.5 | 2.5 | 0.96 | 28 | D | D | D |

In Table 1, PY74 is C.I. Pigment Yellow 74, PB15:3 is C.I. Pigment Blue 15:3, BV 11:4 represents Basic Violet 11:4, and BR 1:1 represents Basic Red 1:1.

From the results indicated in Table 1, it can be seen that the color reproducibility of the image obtained by the resin particle set (electrostatic charge image developing toner set) of each of the examples is more excellent than that of the resin particle set (electrostatic charge image developing toner set) of the comparative examples.

From the results indicated in Table 1 above, it is understood that the resin particle set (electrostatic charge image developing toner set) of each of the examples has a high fluorescence intensity and an excellent image quality in the obtained image.

Example 7

—Preparation of Coated Product—

Each of the fluorescent resin particle and the colored resin particle in the resin particle set of Example 1 is applied to a 10 cm×10 cm square test panel of a zinc phosphate-treated steel plate from a distance of 30 cm from the front with a corona gun manufactured by Asahi Sunac Corporation, while vertically and horizontally sliding the corona gun so as to have a coating film thickness of 30 μm to 50 μm, and then the coated panel is baked under the baking conditions of 180° C. for 30 minutes to prepare a coated product.

It is checked that the prepared coated product has powder attached to the product coated (zinc phosphate-treated steel sheet) and coating is performed thereon.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A resin particle set comprising:

a fluorescent color resin particle containing a fluorescent coloring agent; and a colored resin particle containing a colored coloring agent, wherein a volume average particle diameter of the fluorescent color resin particles is larger than a volume average particle diameter of the colored resin particles, and an average circularity of the fluorescent color resin particles is 0.93 or more.

2. The resin particle set according to claim 1, wherein a volume proportion of the resin particles having a particle diameter of 4 μm or less in the fluorescent color resin particles is 6% or less.

3. The resin particle set according to claim 2, wherein a value of (volume average particle diameter of the fluorescent color resin particles)−(volume average particle diameter of the colored resin particles) is 0.3 μm or more.

4. The resin particle set according to claim 3, wherein the fluorescent coloring agent is a fluorescent dye.

5. The resin particle set according to claim 4, wherein the fluorescent dye contains a fluorescent dye having a maximum fluorescence wavelength in a range of from 580 nm to 650 nm.

6. The resin particle set according to claim 2, wherein the fluorescent coloring agent is a fluorescent dye.

7. The resin particle set according to claim 6, wherein the fluorescent dye contains a fluorescent dye having a maximum fluorescence wavelength in a range of from 580 nm to 650 nm.

8. The resin particle set according to claim 1, wherein a value of (volume average particle diameter of the fluorescent color resin particles)−(volume average particle diameter of the colored resin particles) is 0.3 μm or more.

9. The resin particle set according to claim 8, wherein the fluorescent coloring agent is a fluorescent dye.

10. The resin particle set according to claim 9, wherein the fluorescent dye contains a fluorescent dye having a maximum fluorescence wavelength in a range of from 580 nm to 650 nm.

11. The resin particle set according to claim 1, wherein the fluorescent coloring agent is a fluorescent dye.

12. The resin particle set according to claim 11, wherein the fluorescent dye contains a fluorescent dye having a maximum fluorescence wavelength in a range of from 580 nm to 650 nm.

* * * * *